US005421274A

United States Patent [19]

Gordon et al.

[11] Patent Number: 5,421,274

[45] Date of Patent: Jun. 6, 1995

[54] COAL FIRED STEAM GENERATION APPARATUS WITH EASILY ACCESSIBLE COAL PIPE ORIFICE

[75] Inventors: Everton S. Gordon, Bloomfield, Conn.; John A. Mazeika, Riverside, Ill.

[73] Assignee: Combustion Engineering, Inc., Windsor, Conn.

[21] Appl. No.: 122,944

[22] Filed: Dec. 21, 1993

[51] Int. Cl.[6] ..... F23K 1/00

[52] U.S. Cl. ..... 110/232; 138/40; 138/44; 138/45; 110/309; 110/313

[58] Field of Search ..... 138/40, 44, 45, 46; 110/232, 309, 313

[56] References Cited

U.S. PATENT DOCUMENTS

| | | | |
|---|---|---|---|
| 1,662,374 | 3/1928 | Woodmansee | 138/44 |
| 1,958,854 | 5/1934 | Kellett | 138/44 |
| 2,217,216 | 10/1940 | Davis | 138/44 |
| 2,585,290 | 2/1952 | Walker | 138/44 |
| 2,661,768 | 12/1953 | Novak et al. | 138/44 |
| 4,191,216 | 3/1980 | Connolly | 138/45 |
| 4,393,722 | 7/1983 | Scott | 138/44 |
| 4,422,339 | 12/1983 | Gall et al. | 138/44 |
| 4,628,830 | 12/1986 | Kozlak | 110/232 |
| 4,712,585 | 12/1987 | Evans | 138/44 |
| 5,186,474 | 2/1993 | Jacobs | 138/44 |
| 5,241,915 | 9/1993 | Breen et al. | 110/232 |

*Primary Examiner*—James E. Bryant, III
*Attorney, Agent, or Firm*—Robert S. Smith

[57] ABSTRACT

Apparatus for installation in an associated coal pipe for directing pulverized coal to an associated furnace assembly that includes a housing having an inlet, an outlet, and an access port intermediate the inlet and the outlet. The apparatus also includes a generally circular orifice, a tray dimensioned and configured for carrying and engaging the orifice and apparatus. The chamber is generally aligned with the access port and is dimensioned and configured for receiving the tray with the orifice carried thereon. The apparatus in the housing defining a chamber allows sliding movement of the tray with the orifice carried thereon into and out of the chamber through the access port.

4 Claims, 2 Drawing Sheets

COAL FIRED STEAM GENERATION APPARATUS WITH EASILY ACCESSIBLE COAL PIPE ORIFICE

BACKGROUND OF THE INVENTION

The present invention relates to coal piping for delivering pulverized coal to coal fired steam generators and more particularly to the construction of a coal pipe orifice assembly for us in the coal supply pipes. Coal fired furnaces are typically provided with a plurality of ducts or pipes through which pulverized coal is directed to a plurality of fuel-air admission assemblies arrayed in respective vertically extending windboxes. The windboxes are disposed in one or more walls of the furnace for introducing coal and air into the furnace.

The pipes directing the coal to the respective windboxes have different lengths and different bends and thus it is necessary to balance the flow by means of orifices in each of the pipes. It has been conventional to provide such orifices intermediate end abutting axial sections of pipe. Typically the pipes are large and large couplings or bolted flanges are provided to couple the end abutting axially adjacent portions together.

The orifices require maintenance because the pulverized coal has a severe errosive effect on each orifice. This effect may result in plugging of a coal pipe or decreased performance of the furnace. Accordingly, it is necessary to frequently replace the orifices in the respective coal pipes.

The installation or inspection of a specific orifice often involves a substantial amount of time to remove the various bolts or couplings while simultaneously supporting the respective sections of pipe. More specifically, the process involves supporting the adjacent sections of pipe, removing two couplings, and removing the orifice. After that inspection or replacement, the system must be put back together by inserting the orifice, installing the couplings or bolts in the respective flanges and removing the supports for the respective pipes.

SUMMARY AND OBJECTS OF THE INVENTION

It is an object of the present invention to substantially reduce the cost of inspecting or replacing an orifice in such apparatus.

Still another object of the invention is to provide apparatus that will eliminate the necessity for disconnecting axial sections of the pipe or for providing support for the pipe during the removal and installation of any such orifice.

It has now been found that these and other objects of the invention may be attained in apparatus for installation in an associated coal pipe for directing pulverized coal to an associated furnace assembly which includes a housing having an inlet, an outlet, and an access port intermediate the inlet and the outlet. The apparatus also includes a generally circular orifice, a tray dimensioned and configured for carrying and engaging the orifice and means in the housing defining a chamber. The chamber is generally aligned with the access port and is dimensioned and configured for receiving the tray with the orifice carried thereon. The means allows sliding movement of the tray with the orifice carried thereon into and out of the chamber through the access port.

In some forms of the invention the inlet and the outlet are coaxial. There may be a geometric axis to both the orifice and the associated pipe and the respective geometric axes may be substantially coaxial. The chamber may have side walls that are substantially planar and substantially mutually parallel. The housing is substantially cylindrical in some forms of the invention and the means defining a chamber may include first and second axially spaced shoulders engaging respectively the orifice and the tray to limit axial movement thereof.

The apparatus may also include a plate and means for securing the plate on the access port. The orifice when installed in the chamber may be substantially coaxial with the housing that may have a geometric axis.

BRIEF DESCRIPTION OF THE DRAWINGS

The invention will be better understood by reference to the accompanying drawing in which.

DESCRIPTION OF THE PREFERRED EMBODIMENTS

Figure 2:
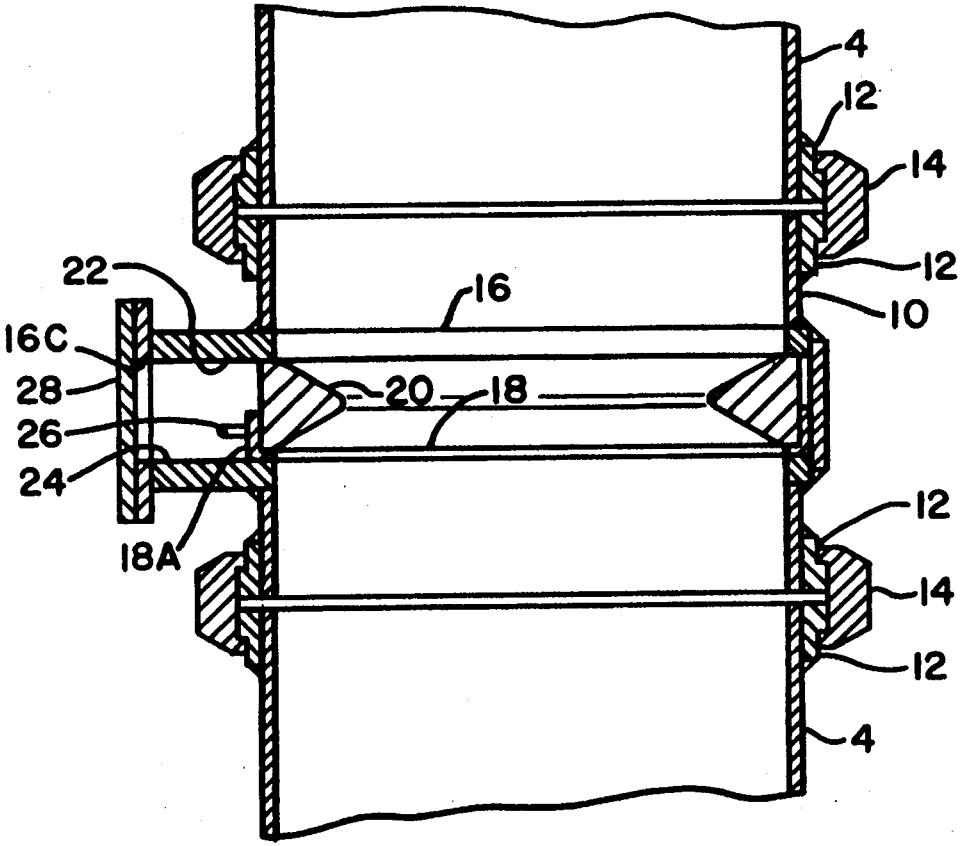
FIG. 2 is a fragmentary sectional view taken through the center line of an axial section of pipe and an orifice assembly according to the present invention.
Figure 1:
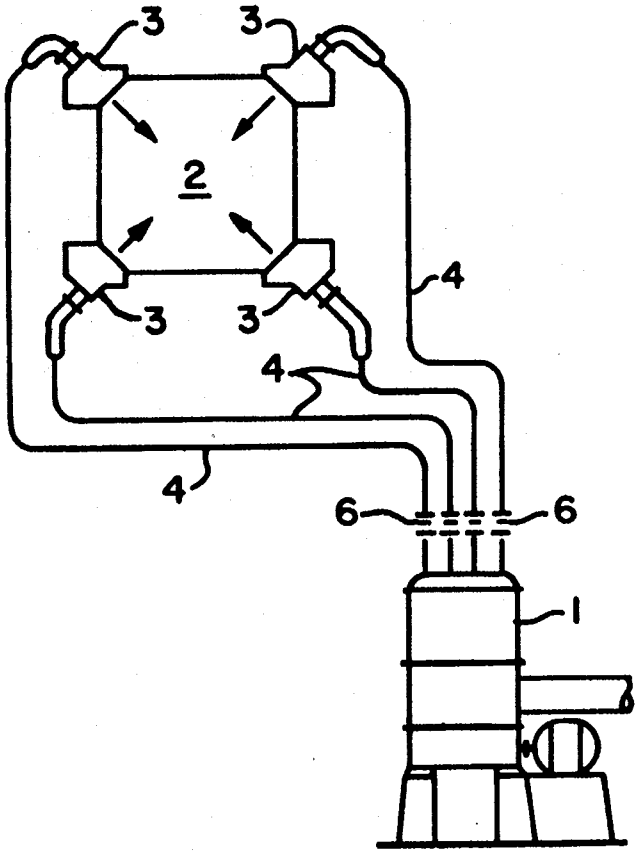
FIG. 1 is a partially schematic view in elevation of a coal pulverizer connected to a plurality of fuel nozzles shown in plan view.
Figure 3:
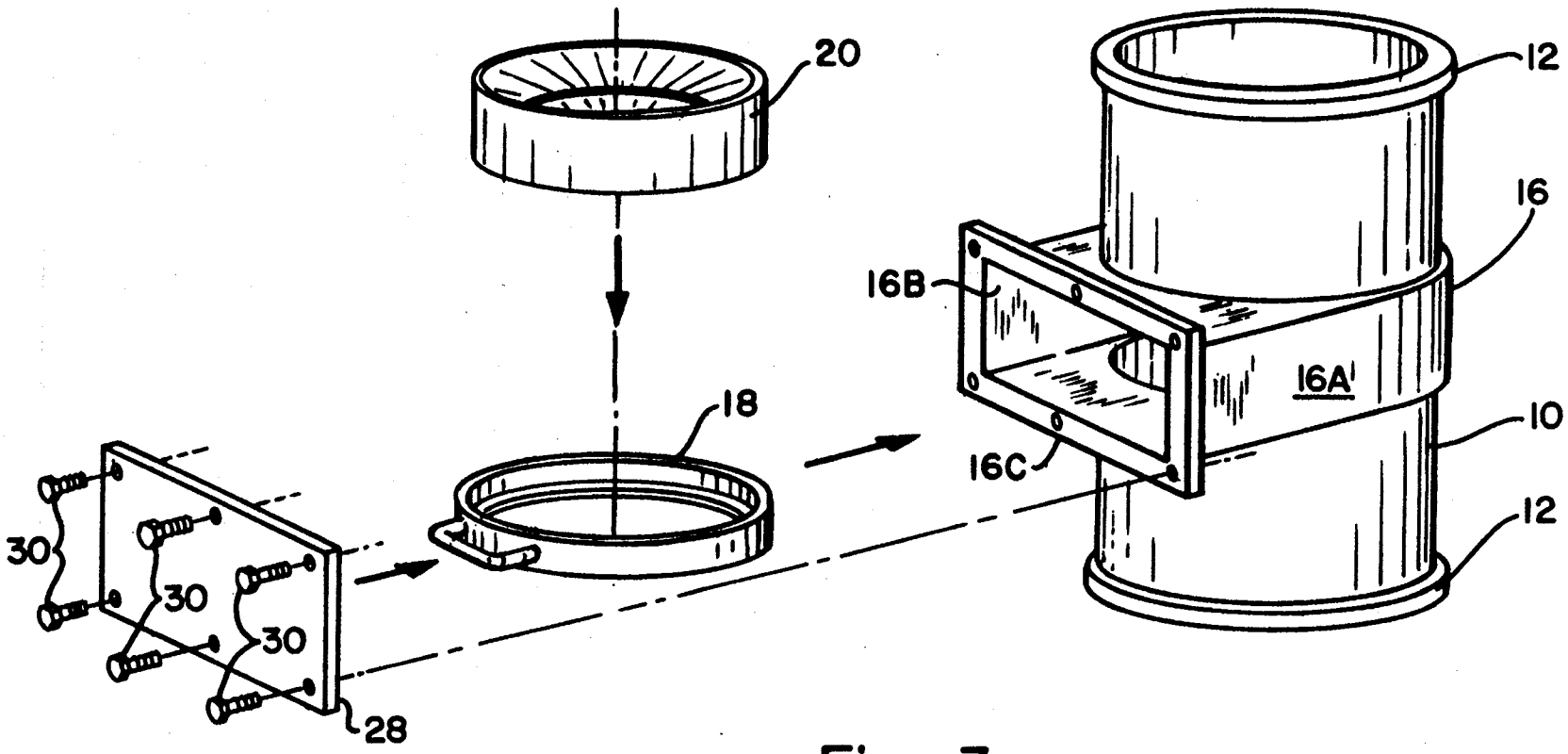
FIG. 3 is an exploded perspective view of the orifice assembly shown in FIG. 2.

Referring now to FIGS. 1–3, there is shown apparatus in which the present invention may be employed. The apparatus includes a coal pulverizer 1 that supplies pulverized coal to a furnace 2. The pulverized coal from the pulverizer 1 is ducted to the furnace 2 by respective ducts or pipes 4, 4, 4, 4. Each is provided with an orifice 6 to ensure that the flow is the same in each duct 4. As best seen in FIGS. 2 and 3, axial sections of existing pipe 4 are disposed in coaxial end abutting relationship to respective ends of a generally cylindrical housing 10.

The existing pipe 4 and the housing 10 are ordinarily cylindrical although other cross-ssections such as square or other polygon shapes may be used. The pipe 4 and the housing 10 each have flanges 12 at the axial extremities thereof. The flanges 12 are welded respectively to sections of pipe 4 and the housing 10. They are dimensioned and configured for engagement with couplings 14 that hold other sections of pipe 4 together.

The axial extremities of the housing 10 are separated by an orifice support chamber 16. The chamber 16 has opposed generally planar walls 16A, 16B that flank a flanged opening 16C. A generally hoop shaped carrier or tray 18 is dimensioned to fit intermediate the planar walls 16A, 16B. An orifice 20 is generally circular and is dimensioned to fit within a peripheral lip 18A of the tray 18 when the tray 18 is intermediate the spaced shoulders 22, 24 of the chamber 16. The shoulders 22 and 24 will be understood to engage only the outer peripheral parts of respectively the orifice 20 and the tray 18. In other words the shoulders 22, 24 allow the free flow of pulverized coal and air through the orifice 20. A handle 26 is provided on the tray 18 to enable a user to reach into the flanged opening 16C and withdraw or insert the tray 18 that carries the orifice 20.

It will be seen that the worker need merely remove a plate shaped cover 28 secured by a plurality of bolts 30 and reach into the flanged opening 16C to remove the tray 18 and orifice 20. There is no necessity for unbolting the couplings 14 or for supporting the pipes 4 while the maintenance or replacement of the orifice 20 is taking place.

This is particularly significant where it may be necessary to repeatedly change the orifice 20 to achieve the precise balance necessary to equalize the flow to the respective windboxes 3. The savings in time are of great significance both in reducing the cost of maintenance work and in minimizing down time of the apparatus.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described our invention, we claim:

1. A coal fired steam generation apparatus which comprises:

a furnace;

a pulverizer;

a plurality of coal pipes extending from said pulverizer to said furnace;

a housing disposed in each of said coal pipes, each of said housings being substantially identical in construction;

each of said housings having an inlet, an outlet; and an access port intermediate said inlet and said outlet;

each of said housings including a generally circular orifice disposed therein;

each of said housings including a tray dimensioned and configured for carrying and engaging the orifice in the housing, each of said trays being hoop shaped and having a peripheral lip, said orifice in each of said housings being dimensioned to fit within a lip of said tray; and each of said housings including means defining a chamber, each of said chambers being generally axially and radially aligned with said access port of the housing associated therewith and being dimensioned and configured for receiving said tray with said orifice carried thereon, said means allowing sliding movement of one of said trays with said orifice carried thereon into and out of said chamber through said access port; each of said means defining a chamber in each housing including first and second axially spaced side walls engaging respectively said orifice and said tray in the respective housing to limit axial movement, said tray not touching said first side wall, said side walls being substantially planar and mutually parallel; each of said housings including a cover plate and means for securing said plate on said access port.

2. The apparatus as described in claim 1 wherein:

each of said means allowing sliding movement allows sliding movement that is radial with respect to the coal pipe in which said housing is disposed.

3. The apparatus as described in claim 2, wherein:

each orifice has a geometric axis, the pipe in which said orifice is disposed has a geometric axis and said geometric axis of said orifice is substantially coaxially with the axis of said coal pipe.

4. The apparatus as described in claim 3, wherein:

each of said housings is substantially cylindrical.

* * * * *